US005504660A

United States Patent [19]

Heidorn

[11] Patent Number: 5,504,660

[45] Date of Patent: Apr. 2, 1996

[54] LENS RETENTION STRUCTURE

[75] Inventor: Richard H. Heidorn, Lombard, Ill.

[73] Assignee: Illinois Tool Works Inc., Glenview, Ill.

[21] Appl. No.: 176,325

[22] Filed: Jan. 3, 1994

[51] Int. Cl.[6] ..... G08B 5/22

[52] U.S. Cl. ..... 362/27; 362/32; 362/246; 362/800; 340/815.45

[58] Field of Search ..... 362/800, 27, 32, 362/246, 812; 116/202; 340/815.49, 815.45, 815.47

[56] References Cited

U.S. PATENT DOCUMENTS

| | | | |
|---|---|---|---|
| Re. 34,254 | 5/1993 | Dragoon | 362/800 |
| 4,271,408 | 12/1981 | Teshima et al. | 362/812 |
| 4,826,273 | 5/1989 | Tinder et al. | 362/32 |
| 5,068,652 | 11/1991 | Kobayashi | 362/800 |
| 5,268,823 | 12/1993 | Yergenson | 362/32 |

*Primary Examiner*—Ira S. Lazarus
*Assistant Examiner*—Sara Sachie Raab
*Attorney, Agent, or Firm*—Schwartz & Weinrieb

[57] ABSTRACT

A display device includes a pair of first and second light sources arranged on a printed circuit board in a spaced-apart but close relationship to each other. A light-shielding tab is interposed between the first and second light sources for shielding light from an illuminated one of the pair of light sources from being transmitted to the other one of the light sources.

22 Claims, 2 Drawing Sheets

LENS RETENTION STRUCTURE

FIELD OF THE INVENTION

This invention relates generally to light sources and more particularly, it relates to a pair of first and second light sources such as light-emitting diodes arranged on a printed circuit board, lens means associated with each of the light sources, and means for preventing light from the first light source passing through its corresponding lens means from interfering with the other light source and its associated lens means when the first light source is illuminated and vice versa.

BACKGROUND OF THE INVENTION

As is generally known in the art, display devices typically include light sources of some type which are illuminated in order to provide visual indications. For example, in recent years there has been an increased use of light-emitting diodes (LED) as the desired light sources on printed circuit boards and the like since they require a relatively small amount of power to drive them. Further, these LEDs are now commercially available in a variety of colors such as red, green, yellow and the like. Many times two LEDs of different colors are mounted in a close side-by-side arrangement on a printed circuit board so as to produce visual indication of certain existing conditions. For instance, a red colored LED may be illuminated to indicate an OFF condition and a green LED may be alternatively illuminated so as to indicate an ON condition.

In order to increase the visibility of the LED light source during its illumination, there can be provided a separate diffusing lens in association with the individual LED light source. However, there is encountered a drawback when two such LED light sources and their associated diffusing lenses are mounted closely together on a printed circuit board. This is because when one of the LED light sources is illuminated so as to pass light through its associated diffusing lens some of this light is also transmitted to the other non-illuminated LED light source and its associated diffusing lens. As a result, the non-illuminated LED light source will also appear to be lit and thus undistinguishable from or confusing with respect to the illuminated LED light source.

Consequently, there has arisen a need for a light-shielding means disposed between a pair of LEDs mounted on a printed circuit board for blocking or preventing the light from being transmitted from the illuminated LED and its associated lens to the non-illuminated LED and its associated lens. It will be expedient to provide the lens with a retention structure so as to securely fix the lens relative to the LED light source.

OBJECTS OF THE INVENTION

Accordingly, it is a general object of the present invention to provide a pair of light sources disposed in close proximity to each other and means disposed between the pair of light sources so as to shield light from being transmitted from each light source to the other light source.

It is an object of the present invention to provide a pair of first and second light sources arranged on a printed circuit board, lens means associated with each of the light sources, and means for preventing light from the first light source passing through its associated lens means from interfering with the other light source and its associated lens means when the first light source is illuminated.

It is another object of the present invention to provide a light-shielding means disposed between a pair of LED's mounted on a printed circuit board for shielding the light from being transmitted from the illuminated LED and its associated lens to the non-illuminated LED and its associated lens.

It is still another object of the present invention to provide a diffusing lens having a retention structure so as to securely fix the lens relative to a light source.

SUMMARY OF THE INVENTION

In accordance with these aims and objectives, the present invention is concerned with the provision of a display device which includes a first light source, a first diffusing lens, a second light source, a second diffusing lens, and a light-shielding tab. The first light source is disposed on a printed circuit board. The first diffusing lens is arranged between the first light source and a cover member of the display device for evenly distributing and diffusing light from the first light source to the outer surface of the cover member. The second light source is disposed on the printed circuit board in a spaced apart but close relationship to the first light source. The second diffusing means is arranged between the second light source and the cover member of the display device for evenly distributing and diffusing light from the second light source to the outer surface of the cover member. The light-shielding tab is interposed between the first light source with its associated first diffusing lens and the second light source with its associated second diffusing lens for shielding light from one of the first and second light sources from being transmitted to the other one of the light sources and its associated diffusing lens.

BRIEF DESCRIPTION OF THE DRAWINGS

These and other objects and advantages of the present invention will become more fully apparent from the following detailed description when read in conjunction with the accompanying drawings with like reference numerals indicating corresponding parts throughout, and wherein.

DESCRIPTION OF THE PREFERRED EMBODIMENT

It is to be distinctly understood at the outset that the present invention shown in association with a computer interface device is not intended to serve as a limitation upon the scope or teachings thereof, but is merely for the purpose of convenience of illustration of one example of its application. The present invention has numerous applications in other fields and apparatus since the invention pertains to a light-shielding tab interposed between a pair of first and second light sources for shielding light from one of the light sources from being transmitted to the other one.

Figure 1:
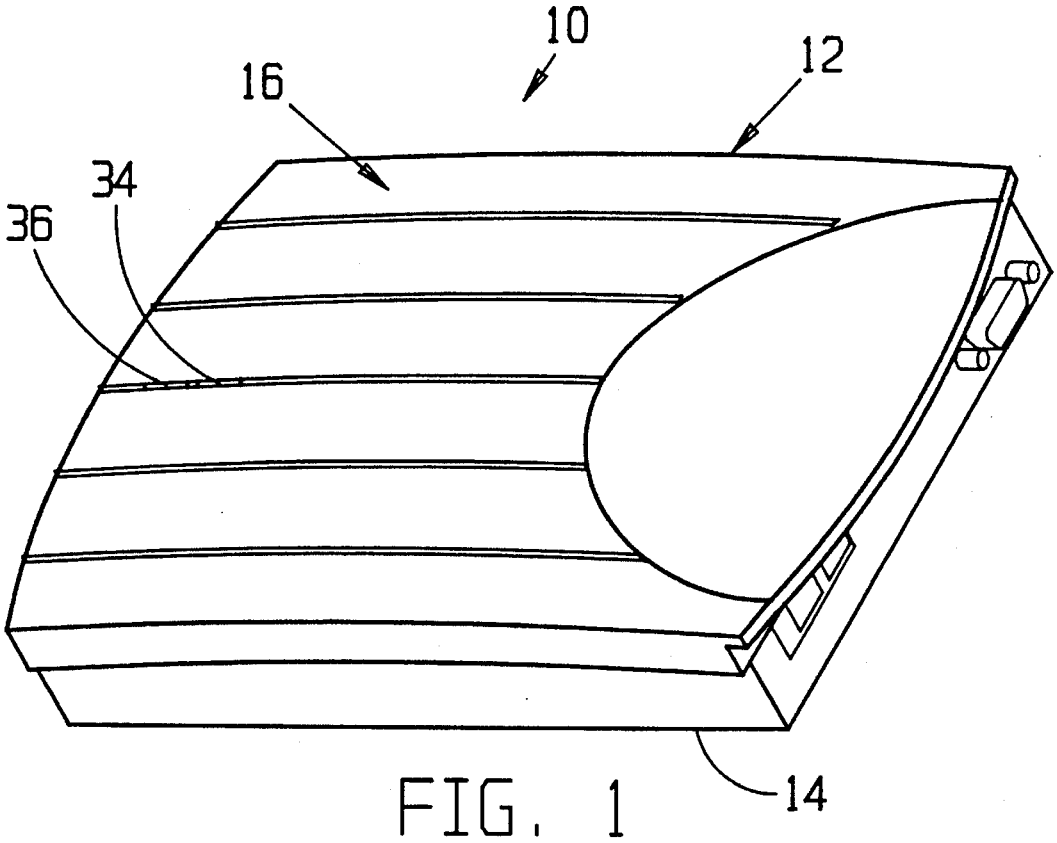
FIG. 1 is a perspective view of a computer interface device employing the features of the present invention.

Referring now in detail to the drawings, there is shown in FIG. 1 a computer interface device designated generally by reference numeral 20 and employing the features of the present invention. The computer interface device 10 is comprised of a rectangularly-shaped enclosure 12 which includes a bottom housing member 14 and a top or cover housing member 16. The cover member 16 is removably secured to the bottom member 14 by conventional fastening means such as screws or the like. The housing members 14 and 16 are preferably formed of a durable plastic material such as polyethylene and the like. The cover member 16 has securely fixed therein a pair of diffusing lenses 34 and 36 whose function and details will be explained more fully hereinafter.

Figure 2:
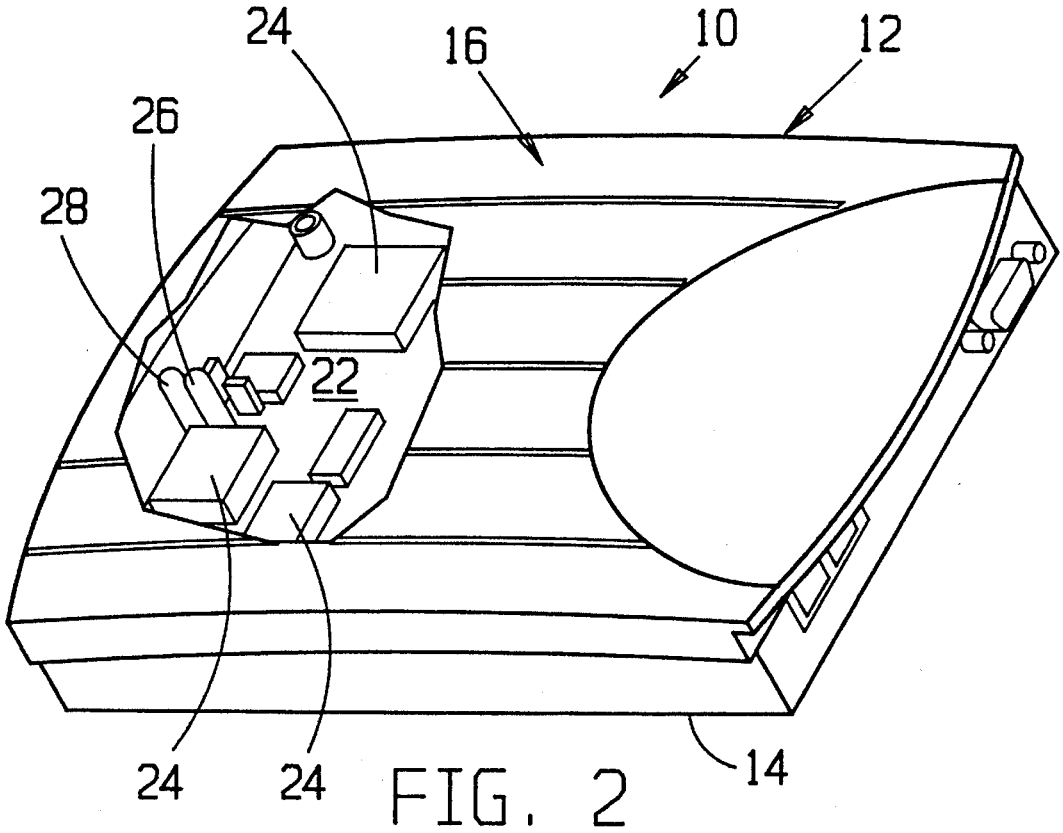
FIG. 2 is a partial cutaway perspective view of the computer interface device of FIG. 1, illustrating the light-shielding means of the present invention.

As can be seen from FIG. 2, a printed circuit board (PCB) 22 is mounted inside the bottom housing member 14 and contains various electrical and electronic components 24, such as semiconductor integrated circuits and the like. There is also mounted on the PCB 22 a pair of light sources 26 and 28 in a close side-by-side arrangement. The light source 26 is preferably formed of a red colored light-emitting diode (LED), and the light source 28 is preferably formed of a green colored light emitting diode. Each of the LEDs is suitably connected to a drive circuit (not shown) for supplying power to the same. When such power is applied to the LED, it will become so-called energized (lit condition or illuminated) so that light is transmitted therefrom and can be visually observed. On the other hand, when no such power is supplied to the LED it is de-energized (unilluminated) so that no light will be Visually observed.

In use, either the red colored LED 26 will be lit or the green colored LED 28 will be lit so as to indicate that a particular condition exists. For example, when the red colored LED 26 is illuminated this may serve to show that a power-off or alarm condition is present. In like manner, when the green colored LED 28 is lit this may be used to indicate that a power-on or safe condition exists. However, when two LEDs are positioned in very close proximity to each other, light from the illuminated LED will be transmitted to the unilluminated or extinguished LED and will cause the unilluminated LED to also appear to be lit. Thus, the observer will have a difficult time in distinguishing between the extinguished LED and the illuminated LED. As a result, there is the possible danger of accident or confusion caused by the inability to determine the existing condition.

Figure 3:
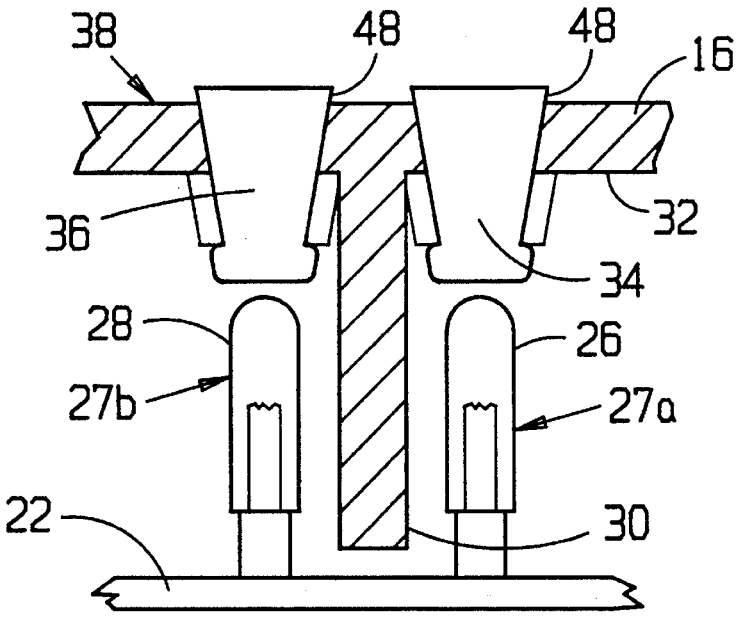
FIG. 3 is an enlarged view of the cut-away area of FIG. 2.

This problem is solved by the present invention which is comprised of a light-shielding tab 30 extending downwardly between the two LEDs mounted on the printed circuit board 22 so as to shield or block light from the illuminated LED to the unilluminated or extinguished LED. As illustrated in FIG. 3, the tab 30 is comprised of a rectangularly-shaped plate which is integrally formed with the interior surface 32 of the cover member 16. The plate is preferably formed of the same opaque plastic material from which the cover member 16 is fabricated. While the plate 30 may be of various dimensions, in the preferred embodiment the width is made to be approximately 0.50 inch, the length is made to be approximately 0.375 inch, and the thickness is about 0.05 inch so as to co-operate with the size dimension of the LEDs.

In order to enhance the brightness of the illuminated LED so as to make it visually distinguishable, there are provided a pair of light concentrator elements 34 and 36. The light concentrator elements 34 and 36 are preferably comprised of diffusing lenses. The diffusing lens 34 associated with the red colored LED 26 is disposed on one side of the plate 30 and is securely fixed to the cover member 16. The diffusing lens 34 extends substantially between the top portion of the LED 26 and the outer surface 38 of the cover member 16. Similarly, the diffusing lens 36 associated with the green color LED 28 is disposed on the other side of the plate 30 and is also fixedly secured to the cover member. The lens 36 extends substantially between the top portion of the LED 28 and the outer surface 38 of the cover member. Since the diffusing lenses 34 and 36 are identical in their construction and operation, it will be sufficient to describe in detail only the lens 34.

Figure 4:
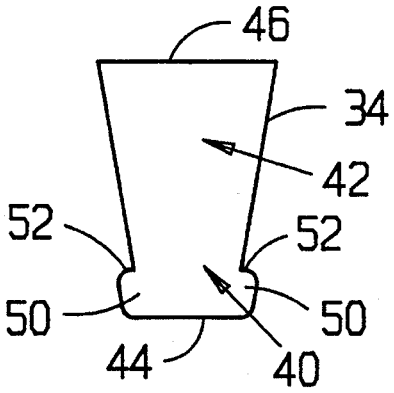
FIG. 4 is a front plan view of the diffusing lens of FIG. 3.
Figure 5:
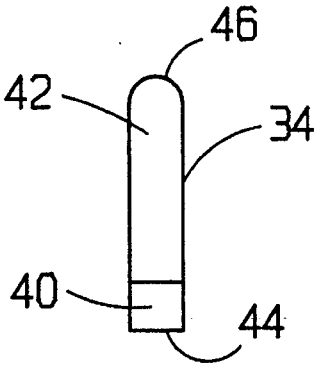
FIG. 5 is a side elevational view of the diffusing lens of FIG. 4.

With attention directed to FIGS. 4 and 5 of the drawings, the diffusing lens 34 is formed of a one-piece construction having a base portion 40 and an upper flared portion 42. The base portion 40 includes a bottom edge 44 through which the light rays from the illuminated LED are free to enter. The upper flared portion 42 includes a top arcuate-shaped edge 46 defining a viewing face where the light rays from the illuminated LED can be visually observed. In this manner, the light rays from the illuminated LED are passed outwardly from its casing **27*a* or 27*b* into the bottom edge 44 of the diffusing lens so as to evenly distribute and diffuse the same upon the viewing face 46. The flared portion 42 is adapted to be press fitted into a narrow slit 48 formed in the cover member 16. The base member 40 further includes a lens retention structure which consists of a pair of radially extending rib members 50. Each of the rib members 50 has a step portion 52 which is used to contactly engage with a portion of the cover member 16** so as to retain and hold the lens in place.

Each of the diffusing lenses 34 and 36 is preferably formed of a translucent polycarbonate material. The lenses may have various dimensions so as to conform to the size dimension of the LEDs. In the preferred embodiment, each of the diffusing lenses has a width of approximately 0.20 inch and a height of approximately 0.28 inch, and a thickness of about 0.05 inch.

In use, when the red colored LED 26 is energized and the green colored LED 28 is de-energized the light rays from the casing **27*a* of the red colored LED will be passed into the bottom edge 44 of the base portion 40 of the diffusing lens 34. If the light-shielding tab 30 of the instant invention were not present, a portion of the light rays from the illuminated red colored LED 26 would also be transmitted to the casing 27*b* of the green colored LED 28 and/or associated lens 36. However, the light-shielding tab 30 will prevent or block the light rays from the red colored LED 26 from being passed through the green colored LED 28 and/or diffusing lens 36. Therefore, the light rays from the red colored LED 26 will only be seen from the viewing face 46 of the diffusing lens 34 and thus become visible to the observer. The viewing face 46 of the diffusing lens 36 will remain dark since the green colored LED 28 is not energized. If the green colored LED 28 is the one energized and the red colored LED is de-energized, the operation will be substantially the same as described, except that the viewing face 46 of the diffusing lens 36 will become illuminated and the viewing face 46 of the diffusing lens 34** will be dark.

From the foregoing detailed description, it can thus be seen that the present invention provides a pair of light sources disposed in close proximity to each other and light-shielding means interposed between the pair of light sources so as to shield light from being transmitted from each light source to the other light source. In the preferred embodiment of the present invention, the light-shielding means is comprised of a rectangularly-shaped tab.

While there has been illustrated and described what is at present considered to be a preferred embodiment of the present invention, it will be understood by those skilled in the art that various changes and modifications may be made, and equivalents may be substituted for elements thereof without departing from the true scope of the invention. In addition, many modifications may be made to adapt a particular situation or material to the teachings of the invention without departing from the central scope thereof. Therefore, it is intended that this invention not be limited to the particular embodiment disclosed as the best mode contemplated for carrying out the invention, but that the invention will include all embodiments falling within the scope of the appended claims.

What is claimed is:

1. A display device, comprising in combination:

an opaque cover member;

a support panel spaced from said opaque cover member so as to define, with said opaque cover member, a space between said support panel and said opaque cover member;

a first light source mounted upon said support panel so as to be disposed within said space defined between said support panel and said opaque cover member;

first light concentrator means, mounted upon said opaque cover member such that a first end portion of said first light concentrator is accessible from a position external to an outer surface portion of said opaque cover member, and a body portion of said first light concentrator means is disposed within said space such that a second end portion of said first light concentrator means is disposed adjacent to said first light source, for evenly distributing and diffusing light from said first light source to said outer surface portion of said opaque cover member;

a second light source mounted upon said support panel so as to also be disposed within said space defined between said support panel and said opaque cover member, and be in a spaced-apart but close relationship with respect to said first light source;

second light concentrator means, mounted upon said opaque cover member such that a first end portion of said second light concentrator means is accessible from a position external to said outer surface portion of said opaque cover member, and a body portion of said second light concentrator means is disposed within said space such that a second end portion of said second light concentrator means is disposed adjacent to said second light source, for evenly distributing and diffusing light from said second light source to said outer surface portion of said opaque cover member; and opaque light-shielding means integrally formed with said opaque cover member and extending from said opaque cover member to a position immediately adjacent to said support panel so as to be interposed between said first light source and its associated first light concentrator means, and said second light source and its associated second light concentrator means, and to divide said space into first and second cells separated by and defined upon opposite sides of said light-shielding means, for preventing light from being transmitted from one of said first and second light sources disposed within one of said first and second cells to the other one of said first and second light sources and its corresponding light concentrator means disposed within the other one of said first and second cells.

2. A display device as claimed in claim 1, wherein said first light source comprises a first light-emitting diode.

3. A display device as claimed in claim 2, wherein said second light source comprises a second light-emitting diode.

4. A display device as claimed in claim 1, wherein said light-shielding means comprises a rectangularly-shaped tab which is formed integrally with an interior surface portion of said cover member.

5. A display device as claimed in claim 4, wherein:

said tab and said cover member comprise a single-piece structure such that both said tab and said cover member are formed from an opaque plastic material.

6. A display device as claimed in claim 1, wherein said first light concentrator means comprises a first diffusing lens.

7. A display device as claimed in claim 6, wherein said second light concentrator means comprises a second diffusing lens.

8. A display device as claimed in claim 7, wherein each of said first and second diffusing lenses includes a base portion and an upper flared portion.

9. A display device as claimed in claim 8, wherein said base portion includes lens retention means for fixedly engaging a portion of said cover member so as to retain said diffusing lens in place upon said cover member.

10. A display device as claimed in claim 9, wherein:

each one of said first and second diffusing lenses has a longitudinal extent; and said lens retention means of each base portion of each diffusing lens comprises a pair of radially extending rib members formed upon said base portion of each diffusing lens and having a step portion for engaging said portion of said cover member.

11. A display device as claimed in claim 7, wherein each of said first and second diffusing lenses is formed of a translucent polycarbonate material.

12. A display device as claimed in claim 8, wherein said flared portion is adapted to be press fitted into a narrow slit formed in said cover member, said flared portion having a top arcuate-shaped edge defining a viewing face where the light from the illuminated one of said first and second light sources can be visually observed.

13. A display device, comprising in combination:

an opaque cover member;

a support panel spaced from said opaque cover member so as to define, with said opaque cover member, a space between said support panel and said opaque cover member;

a first light source disposed upon said support panel and having a first longitudinal extent such that said first light source is disposed within said space defined between said support panel and said opaque cover member;

first light concentrator means, having stepped ribs for fixedly mounting said first light concentrator means within said opaque cover member such that a first end portion of said first light concentrator means is accessible from a position external to an outer surface portion of said opaque cover member, while a body portion of said first light concentrator means is disposed within said space defined between said support panel and said opaque cover member such that a second end portion of said first light concentrator means is disposed adjacent to said first light source, for evenly distributing and diffusing light from said first light source to said outer surface portion of said opaque cover member;

a second light source disposed upon said support panel in a spaced-apart but close relationship with respect to said first light source and having a second longitudinal extent such that said second light source is disposed within said space defined between said support panel and said opaque cover member;

second light concentrator means, having stepped ribs for fixedly mounting said second light concentrator means within said opaque cover member such that a first end portion of said second light concentrator means is accessible from a position external to said outer surface portion of said opaque cover member, while a body portion of said second light concentrator means is disposed within said space defined between said support panel and said opaque cover member such that a second end portion of said second light concentrator means is disposed adjacent to said second light source, for evenly distributing and diffusing light from said second light source to said outer surface portion of said opaque cover member; and opaque light-shielding means integrally formed with said opaque cover member, having a third longitudinal extent which is at least as great as said first and second longitudinal extents of said first and second light sources, and extending from said opaque cover member to a position immediately adjacent to said support panel so as to be interposed between said first light source and its associated first light concentrator means, and said second light source and its associated second light concentrator means, and to divide said space defined between said support panel and said opaque cover member into first and second cells separated by and defined upon opposite sides of said light-shielding means, for substantially preventing light from being transmitted from an illuminated one of said first and second light sources disposed within one of said first and second cells to the other one of said first and second light sources and its corresponding light concentrator means disposed within the other one of said first and second cells along substantially the entire longitudinal extents of said first and second light sources.

14. A display device as claimed in claim 13, wherein said first light source means comprises a first light-emitting diode.

15. A display device as claimed in claim 14, wherein said second light source means comprises a second light-emitting diode.

16. A display device as claimed in claim 15, wherein said light-shielding means comprises a rectangularly-shaped tab.

17. A display device as set forth in claim 13, wherein:

said opaque cover member and said opaque light-shielding means are integrally formed as a one-piece structure such that both said opaque cover member and said opaque light-shielding means are formed from an opaque plastic material.

18. A display device, comprising in combination:

an opaque cover member;

a support panel spaced from said opaque cover member so as to define, with said opaque cover member, a space between said support panel and said opaque cover member;

first illumination means mounted upon said support panel for transmitting light rays when energized and having a first longitudinal extent such that said first illumination means is disposed within said space defined between said support panel and said opaque cover member;

first light concentrator means, having stepped rib members for fixedly mounting said first light concentrator means within said opaque cover member such that a first end portion of said first light concentrator means is accessible from a position external to an outer surface portion of said opaque cover member, while a body portion of said first light concentrator means is disposed within said space defined between said support panel and said opaque cover member such that a second end portion of said first light concentrator means is disposed adjacent to said first illumination means, for evenly distributing and diffusing light from said first illumination means to said outer surface portion of said opaque cover member;

second illumination means mounted upon said support panel in a spaced-apart but close relationship with respect to said first illumination means for transmitting light rays when energized and having a second longitudinal extent such that said second illumination means is disposed within said space defined between said support panel and said opaque cover member;

second light concentrator means, having stepped rib members for fixedly mounting said second light concentrator means within said opaque cover member such that a first end portion of said second light concentrator means is accessible from a position external to said outer surface portion of said opaque cover member, while a body portion of said second light concentrator means is disposed within said space defined between said support panel and said opaque cover member such that a second end portion of said second light concentrator means is disposed adjacent to said second illumination means, for evenly distributing and diffusing light from said second illumination means to said outer surface portion of said opaque cover member; and opaque light-shielding means, integrally formed with said opaque cover member, having a third longitudinal extent which is at least as great as said first and second longitudinal extents of said first and second illumination means, and extending from said opaque cover member to a position immediately adjacent to said support panel so as to be interposed between said first illumination means and its associated first light concentrator means, and said second illumination means and its associated second light concentrator means, and to divide said space defined between said support panel and said opaque cover member into first and second cells separated by and defined upon opposite sides of said opaque light-shielding means, for substantially preventing light rays from being transmitted from an energized one of said first and second illumination means disposed within one of said first and second cells to the other one of said first and second illumination means and its corresponding light concentrator means disposed within the other one of said first and second cells along substantially the entire longitudinal extents of said first and second illumination means.

19. A display device as claimed in claim 17, wherein said first illumination means comprises a first light-emitting diode.

20. A display device as claimed in claim 18, wherein said second illumination means comprises a second light-emitting diode.

21. A display device as claimed in claim 19, wherein said light-shielding means comprises a rectangularly-shaped tab.

22. A display device as set forth in claim 18, wherein:

said opaque cover member and said opaque light-shielding means are integrally formed as a one-piece structure such that both said opaque cover member and said opaque light-shielding means are formed from an opaque plastic material.

* * * * *